US006516070B2

(12) United States Patent
Macey

(10) Patent No.: US 6,516,070 B2
(45) Date of Patent: Feb. 4, 2003

(54) SPA AUDIO SYSTEM OPERABLE WITH A REMOTE CONTROL

(75) Inventor: Stephen S. Macey, Oceanside, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 0 days.

(21) Appl. No.: 09/865,127

(22) Filed: May 24, 2001

(65) Prior Publication Data

US 2002/0025050 A1 Feb. 28, 2002

Related U.S. Application Data

(63) Continuation-in-part of application No. 09/516,132, filed on Mar. 1, 2000.

(51) Int. Cl.[7] ..... H04R 25/00; H04R 1/02; H04H 5/00

(52) U.S. Cl. ..... 381/152; 381/2; 381/333; 381/124; 381/189

(58) Field of Search ..... 381/90, 124, 189, 381/300, 301, 334, 2, 152

(56) References Cited

U.S. PATENT DOCUMENTS 3,590,382 A * 6/1971 Kenney ..... 325/36
6,332,029 B1 * 12/2001 Azima et al. ..... 381/152

OTHER PUBLICATIONS

Clark Synthesis Tacile Sound, Installation and Operation Guide, 1997, Clark Synthesis, Inc., p. 6.*
X–10 USA, Product Information, 1997.*

* cited by examiner

*Primary Examiner*—Forester W. Isen
*Assistant Examiner*—Elizabeth McChesney
(74) *Attorney, Agent, or Firm*—Snell & Wilmer, LLP

(57) ABSTRACT

A portable spa including an audio system designed to use the spa shell as the sound generating device. Transducer devices are mounted within an enclosure which is bonded to the spa shell so as to couple the sound vibration energy to the shell so that sound can be heard when using the spa.

18 Claims, 4 Drawing Sheets

SPA AUDIO SYSTEM OPERABLE WITH A REMOTE CONTROL

CROSS REFERENCE TO RELATED APPLICATIONS

This is a Continuation-In-Part of application Ser. No. 09/516,132, entitled SPA AUDIO SYSTEM, filed Mar. 1, 2000, and is related to co-pending application Ser. No. 09/865,010, entitled TWO-WAY RF REMOTE CONTROL, filed on May 24, 2001, the same day as the present application, by the same inventor as the present application, and assigned to the same Assignee as the present application. Both applications, U.S. Ser. No. 09/516,132 and U.S. Ser. No. 09/865,010, are incorporated herein by reference.

BACKGROUND OF THE INVENTION

1. Field of the Invention

The subject invention relates generally to spas and more particularly to an audio system utilizing a spa shell as a sound-generating device and having a remote control therefor.

2. Description of Related Art

Existing spa audio systems use traditional speakers wherein the audio drivers are exposed to the harsh spa environment or require protection or esoteric materials to prevent premature failure. Existing spa audio systems also suffer from the limited space available to mount speakers. The resultant smaller speakers are incapable of reproducing full range audio (50 Hz–17 kHz).

Remote controls for electronic apparatus are not new. However, such prior art remote control devices use infrared light or sound for communicating with the controlled apparatus. These prior devices are quite satisfactory when used in the same room as the apparatus being controlled.

Therefore, a need exist for a remote control that can be used at locations without line of sight communication with the apparatus being controlled.

SUMMARY OF THE INVENTION

An object of the present invention is to provide a remote control for a spa audio system that can receive a return signal indicative of the status of a given function of the system.

Another object of the present invention is to provide feedback from the spa audio system that indicates such things as power-on, status of the audio system, audio media selected, volume setting, etc.

Still another object of the present invention is to provide a spa audio system that employs an existing home entertainment system without the necessity of additional or special wiring.

Yet another object of this invention is to provide a remote control that is simple to use by employing only three button controls, one button for mode selection, and two buttons for ON or OFF/increase or decrease of the selected mode.

According to an aspect of the invention, a spa shell is employed as an audio driver with audio transducers mounted inside the skirt of the spa. The inventor has found that the spa shell provides both sufficient rigidity for high frequency reproduction and a sufficiently large surface area to achieve low frequency reproduction.

These and other objects, which will become apparent as the invention is described in detail below, are provided by an audio system for a spa having a flexible shell for holding water and a main control for controlling functions of the spa.

The spa audio system includes a first transceiver coupled to a home stereo system and a second transceiver coupled to the main control. An amplifier is coupled to the main control and has outputs coupled to audio transducers. The audio transducers are attached to an outer portion of the spa shall for coupling sound vibration energy to the spa shell.

Still other objects, features and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims.

BRIEF DESCRIPTION OF THE DRAWINGS

The general purpose of this invention, as well as a preferred mode of use, its objects and advantages will best be understood by reference to the following detailed description of an illustrative embodiment with reference to the accompanying drawings in which like reference numerals designate like parts throughout the figures thereof, and where.

DETAILED DESCRIPTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved spa audio system and a RF remote control apparatus for controlling the same.

Figure 1:
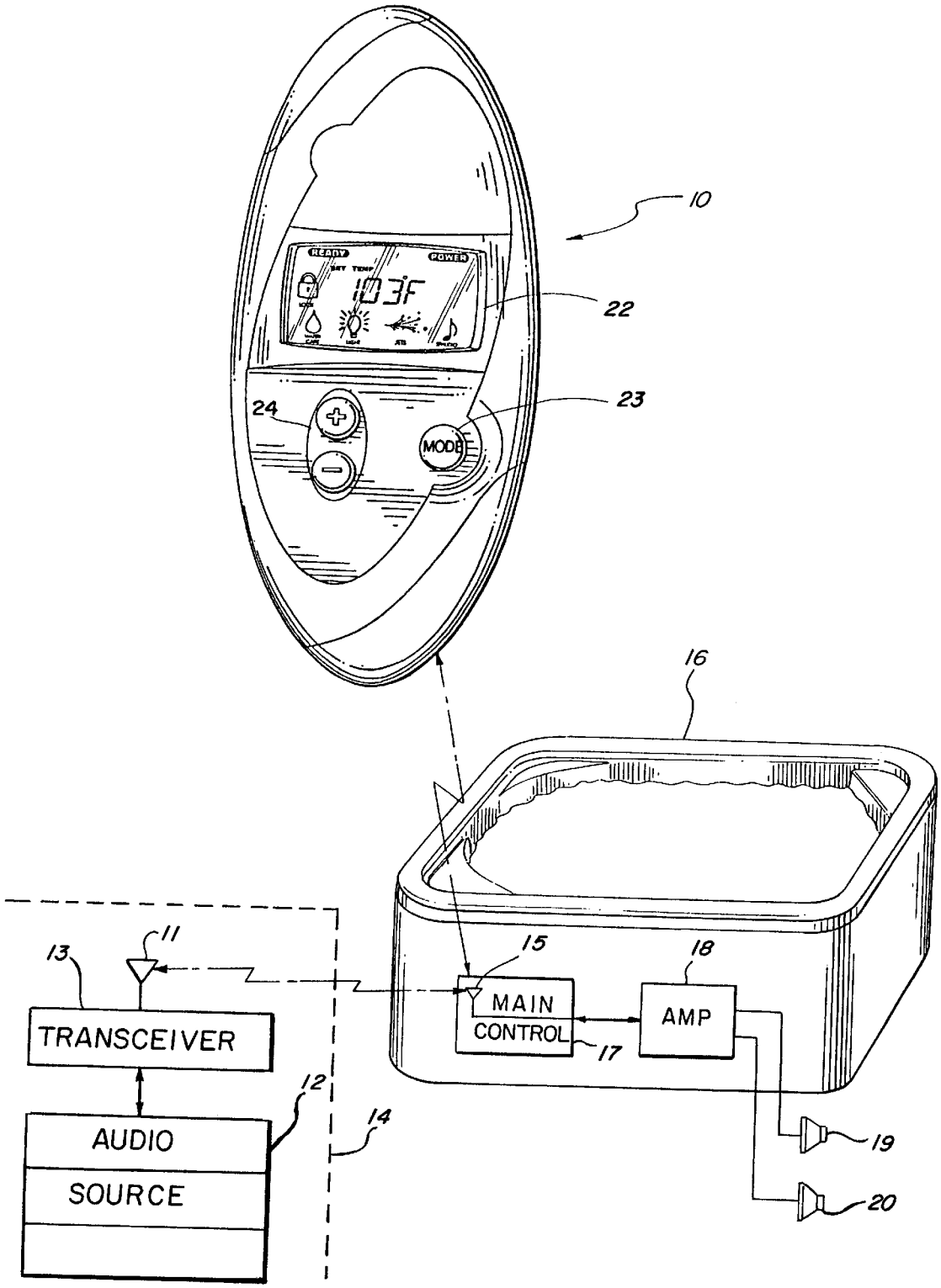
FIG. 1 is a diagram partially in perspective and partially in block diagram form illustrating a remote control for use with a spa audio system in accordance with a specific embodiment of the present invention.

Referring now to the drawings and FIG. 1 in particular, a remote control 10 is illustrated in use with a spa audio system in accordance with a specific embodiment of the present invention. RF signals from the remote control 10 are low power, but adequate to reach an antenna 15 coupled to a main control 17 within or near a spa 16. The main control then communicates with an audio source 12 through an antenna 11 and a transceiver 13 within a house or structure 14. The antenna 11 is capable of transmitting media material (e.g., music) back to the antenna 15 within the spa 16. The music carrying signal picked up by the antenna 15 is processed by the main control signal 17 and amplified by an amplifier 18, where it is then supplied to speakers 19, 20 affixed to the shell of the spa 16 as will be explained hereinafter. The amplifier 18 may be a conventional integrated power amplifier, providing e.g., 100–300 watts of power per channel. The remote control 10 and the main control 17 are described in greater detail in U.S. Pat. application Ser. No. 09/865,010, entitled TWO-WAY RF REMOTE CONTROL filed on May 24, 2001.

The signal power transmitted by the antenna 11 is preferably low so to avoid interference with a neighbor's radio or television reception, but strong enough to reach the spa outside of the structure 14. The remote also receives status signals back from the home stereo 12 regarding the status of such things as the media selected, volume, and the like; which will be explained further hereinafter. The remote control 10 includes a display 22 having icons displayed thereon, which represent various functions to be described hereinafter. The remote control 10 also includes a mode button 23 for changing the function of the remote from one mode to another; and, a +/– ("ON/OFF" or "increase/decrease") button 24 for use in conjunction with the mode button 23 for changing or setting a function. The remote control 10 is powered by three AAA batteries, is waterproof and may be used while bathing in the spa 16.

Figure 2:
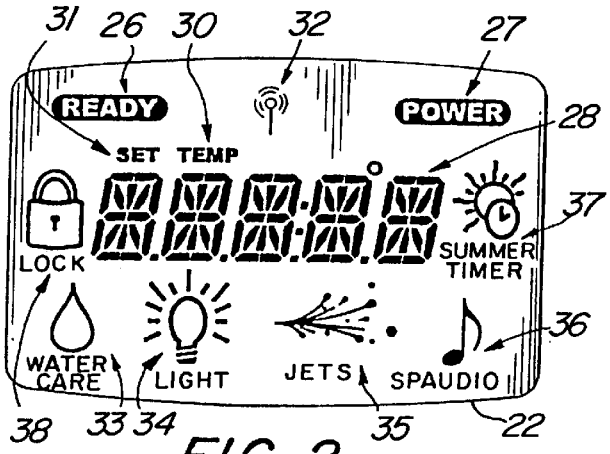
FIG. 2 is a front view of the display of the remote control.

Referring now to FIG. 2, the display 22 of the remote control 10 is shown in greater detail. The display 22 includes numerous icons, which indicate the status of various functions of the spa 16. A Ready icon 26 will illuminate when the temperature of the water in the spa 16 is within 2 degrees of the selected temperature. A Power icon 27 will illuminate when the spa system is turned on and power is connected. An Alpha/Numeric display array 28 is disposed for indicating numerous functions selected by the mode switch 23, or for displaying information received back from the main control 15. For example, when the temperature is selected, a Temp icon 30 illuminates and the temperature of the water is indicated by the display array 28. When a temperature setting is to be selected, a Set icon 31 will illuminate and as the +/– switch 24 is moved (up or down) the temperature to be selected will be shown by the display array 28. As the remote control 10 communicates with the transceiver 13 a Comm icon 32 will flash, which indicates communication is taking place between the two units.

Additional functions indicated by the display 22 include a Water Care icon 33, which when illuminated indicates that the sanitary system of the spa 16 is operating normally. A Light icon 34 will illuminate when the mode switch 23 is stepped to the spa light switch. Depressing the + side of the switch 24 will turn the spa light on and depressing the – side of the same switch 24 will turn the spa light off. In a similar fashion, the jets of the spa can be turned on and off, and when the mode switch is in the jets mode a Jets icon 35 illuminates. A SpAudio icon 36 illuminates when the mode switch is stepped to this function, and when the + side of the switch 24 is depressed, the SpAudio turns on. In a similar manner, when the – side of the switch 24 is depressed the SpAudio turns off.

A Summer Timer icon 37 illuminates when the mode switch 23 is stepped to this function, and when the + side of the switch 24 is depressed, this function is turned on; in a similar manner, when the – side of switch 24 is depressed this function is turned off. The Summer Timer function is useful in a warm climate. For example, in a place like Arizona in the summer time the ambient temperature may be quite high. Also, a feature of the spa 16 is to continuously circulate the water by a heater to maintain a set temperature. In a warm climate, when using the water circulate feature, the water temperature may rise above a desired setting. Accordingly, by turning on the Summer Timer function, the water is not circulated continuously in order to help maintain the preset desired temperature.

Another function indicated by the display 22 is a Lock icon 38. The Lock function can do two things. First, the entire spa system can be locked so that no one can make changes to the settings, unless they have the remote control. Secondly, the temperature setting can be locked to a preselected setting while the other functions are accessible.

Figure 3A:
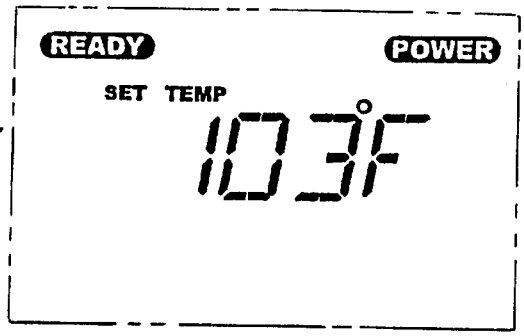
FIGS. 3A–3F are diagrammatic illustrations of various data displays for the remote control shown in FIGS. 1 and 2.
Figure 3B:
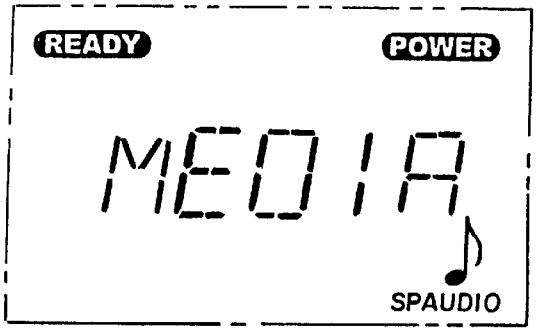
Figure 3C:
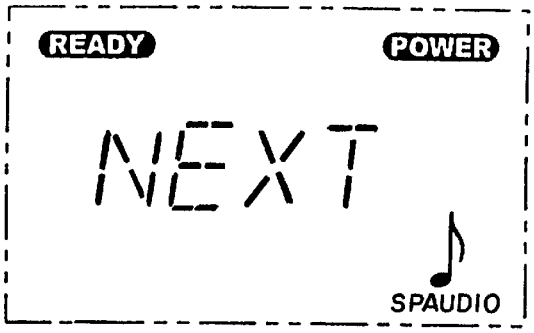
Figure 3D:
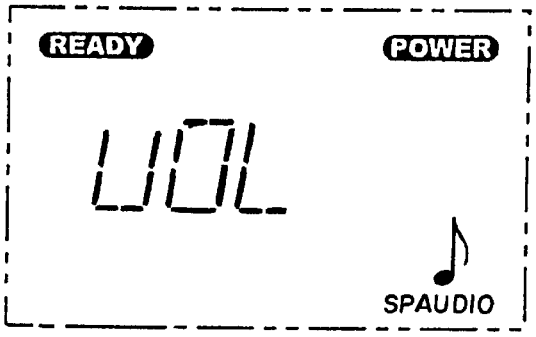
Figure 3E:
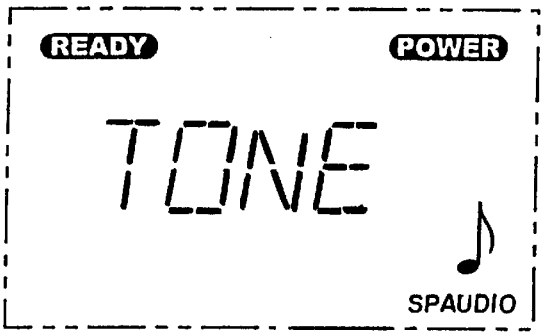
Figure 3F:
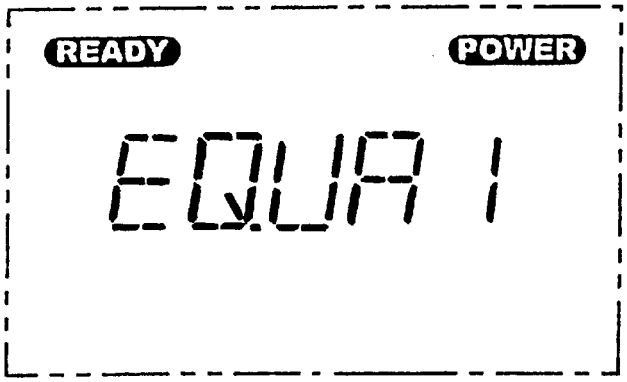

Referring now to FIGS. 3A through 3F, a variety of displays that may be shown by the display 22 of the remote control 10 are depicted. FIG. 3A shows a set temperature display, which is explained in greater detail in the above-cited co-pending patent application Ser. No. 09/865,010. Note that the Ready and Power icons 26 and 27, respectively, are illuminated, as well as the Set and Temp icons, 31 and 32, respectively; and, the temperature setting of 103° F. is shown. FIG. 3B shows the display when the remote control 10 is set to the Spa Audio function in the Media mode. Note that the word MEDIA appears across the display array 28. FIG. 3C shows the SpAudio function is in the NEXT mode, which means that each depression of the switch 24 will step to the next radio station or track on a CD for example, of the stereo system 12. FIG. 3D shows the display when the SpAudio function is in the Volume setting mode. Each depression of the switch 24 will increase or decrease the volume setting of the stereo system 12. FIG. 3E shows the display array 28 when the SpAudio function is in the Tone setting mode. Each depression of the switch 24 will change the tone of the stereo system 12, wherein depressing the plus side of the switch 24 increases treble tone while depressing the minus side decreases treble or increases bass. FIG. 3F shows the display array 28 when the SpAudio function is in the Equalizer mode. Each depression of the switch 24 will select a different equalization curve, wherein each curve is preset for a different type of music. For example, curve one could be pre-set for classical music, curve two could be pre-set for jazz, curve 3 could be pre-set for rock and roll curve 4 could be pre-set for soft music and curve 5 could be pre-set for easy listening.

Figure 4:
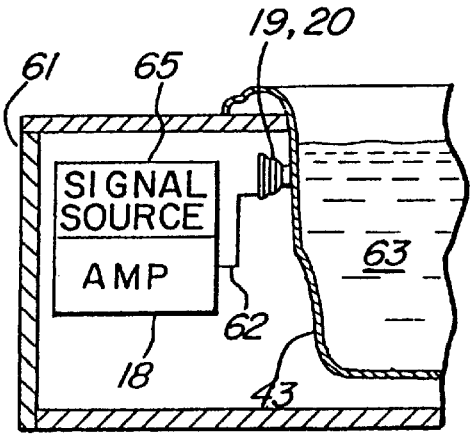
FIG. 4 is a cross-section of a spa shell in an enclosure diagrammatically showing transducers attached to the spa shell.

FIG. 4 illustrates a spa audio system according to an embodiment of the present invention. According to this embodiment, audio transducer devices 19, 20 are bonded to a spa shell 43. The transducer devices 19, 20 couple the sound vibration energy so that sound can be heard when using the spa. Two transducer devices 19, 20 are preferably provided for stereo effect but one device or more than two devices may also be used. The transducer devices 19, 20 are driven by an amplifier 18.

The spa shell 43 is rigid enough to support the weight of water and bathers but is sufficiently compliant to reproduce the full range of audio frequencies. A typical spa shell 43 is formed of thermoset plastic or thermoplastic and has a thickness of 0.100–0.300 inches. Of course, other materials and dimensions providing the functional prerequisites for water/bather support and audio transmission may be employed.

Rigid engagement of each transducer device 19, 20 to the spa shell 43 is required. The installation method prevents spa insulation material from contaminating the transducer to shell coupling. This is achieved by constructing the transducer device 19 as a formed enclosure that surrounds a transducer element. A suitable audio transducer element that may be used in the enclosure is Model TST 329 as available from Clark Synthesis, Inc., 8122 S. Park Lane, Littleton, Colo. 80120.

Figure 5:
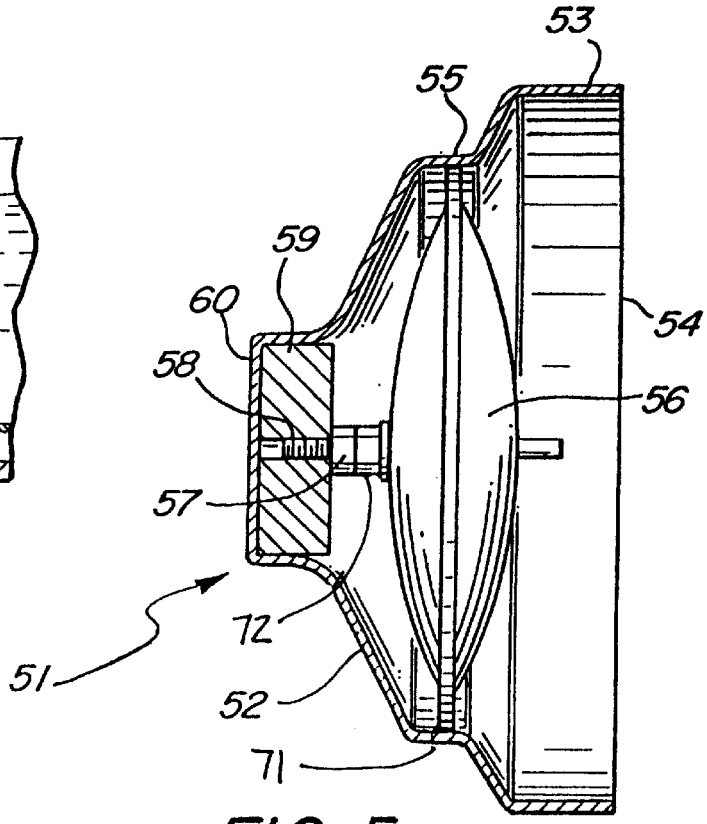
FIG. 5 is a cross-sectional diagram of a transducer in its enclosure as used in the present invention.

An illustrative formed enclosure 51 is shown in FIG. 5. This enclosure 51 includes a thermoformed molded plastic housing 52, which may be fabricated for example, from ⅛" ABS plastic. The housing 52 includes an outer cylindrical shell portion 53, which provides a circular rim or edge 54 at its open end.

Adjacent the rim 54 of the enclosure 51, a somewhat smaller concentric clindrical portion 55 is provided, which is of a diameter selected to support the outer rim 71 of the transducer element 56. A nut 57 is threaded onto a threaded projection 72 of the tranducer 56 and receives a threaded end of a stud 58. The stud 58 threads into a plastic cylindrical plug or puck 59 formed at a dosed end 60 of the housing 52, thereby attaching and further supporting the transducer 56 within the housing 52. Attachment of the closed end 60 to the spa shell 43 and the plug 59 to the inside of the closed end 60 of housing 52 is preferably provided by gluing the end 60 to the shell 43 using e.g., ABS glue or other typical adhesives such as fiberglass or permalite. Structural foam might also be used. After the plug 59 is glued into the closed end 60, the transducer 56 is threaded on to the nut 57 by its threaded projection 72.

Additionally, support to the rim 54 of the housing 52 may be provided, for example, via a brace attached to the spa frame structure in order to relieve any shear stress created by hanging the housing/transducer assembly off the side of the spa shell 43. A hatch or door in the spa skirt 61 may also be provided to access the enclosures and equipment.

The output signal of the amplifier 18 may be coupled to the transducers via conventional speaker wire 62. In such case, the amplifier 18 and a signal source 65 supplying inputs thereto, such as a tuner or CD player, may be located in a compartment within the spa skirt 61 or elsewhere, such as in the structure 14. Alternatively, as shown in FIG. 1, the remote transceiver 13 (e.g., RF) may be used to enable use of the homeowner's home audio system 12 as the music signal source. Such remote transmitting devices are commercially available, for example, the 900 MHz or 2.4 GHz wireless receiver/transmitters provided by X-10 USA, Closter, N.J. 07624.

In operation, the audio can be heard under water 63 as well as above the water. Listeners outside the spa can also hear the audio signal, but the experience is muted compared to that of the tub occupant.

As may be appreciated, the disclosed embodiment permits the audio transducer devices to be enclosed within the spa, providing improved aesthetics by eliminating exposed speaker locations. Enclosing the transducer devices within the spa also protects them from water and reduces the risk of water exposure to electrical signals.

Figure 6:
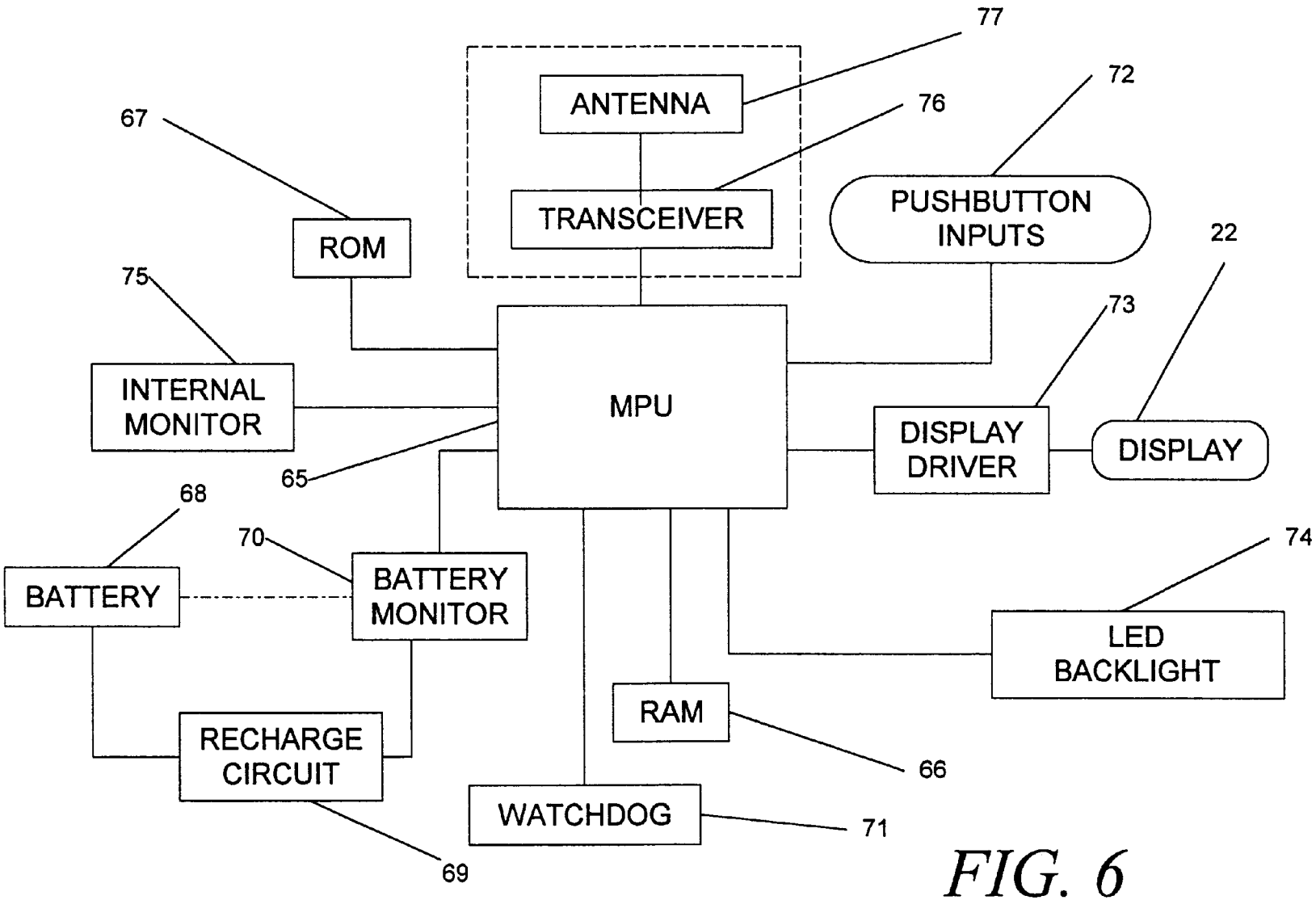
FIG. 6 is a block diagram of the electronic structure of the remote control.

Referring now to FIG. 6, a block diagram of the electronic structure of the remote control is shown. The center of the remote control 10 is a Microprocessor Unit ("MPU") 65. The MPU 65 has coupled thereto a RAM 66 and a ROM 67, which are conventional peripherals to a microprocessor and will not be described further herein. Also, the MPU 65 is powered by a battery 68, which in a specific embodiment includes three AAA batteries. A battery recharge circuit 69 and a battery monitor 70 are coupled between the battery 68 and the MPU 65, which are also well known in the art and will not be amplified further herein. A watchdog circuit 71 is also coupled to the MPU 65 to make sure the commands are being executed properly.

Pushbutton inputs 72 are coupled to input terminals of the MPU 65 to receive signals from the mode button 23 or the +/− switch 24. Display Driver 73 are coupled to outputs of the MPU 65 in a conventional manner, which in turn drive the display 22 described hereinabove. The display 22 also includes a back light 74 made up of Light Emitting Diodes ("LED"). An Internal Monitor circuit 75 is disposed for detecting any non-conforming operation of the MPU 65. RF signals are transmitted from the remote control 10 or received from the transceiver 13 by means of another transceiver 76 and an antenna 77.

From the above description, those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. In a spa having a flexible shell for holding water, an audio system using the flexible shell of the spa as a speaker, comprising:

a) a first transceiver coupled to a source of audio signal and being disposed at a location other than said spa;

b) a second transceiver coupled to an input of an amplifier, the amplifier having an output; and c) an audio transducer having an enclosure closed at a first end and open at a second end, the enclosure attached to an outer portion of the spa shell by its first end, and a transducer mounted in the enclosure for coupling sound vibration energy to the spa shell through the first end of the enclosure, the transducer being coupled to the output of the amplifier.

2. The spa audio system according to claim 1 wherein the source of audio signals is a home stereo system.

3. The spa audio system according to claim 2 further comprising:

a remote control capable of sending and receiving RF signals; and a spa main control coupled to said second transceiver, said second transceiver being responsive to RF signals from the remote control and sending RF swirls to the remote control.

4. The spa audio system according to claim 3 wherein said remote control sends selection RF signals to said spa main control by way of said second transceiver and said spa main control relays any received home stereo selection control signals to said first transceiver via said second bank for making stereo selections of said home stereo system.

5. The spa audio system according to claim 4 wherein the selection control signals of said home stereo system is volume control.

6. The spa audio system according to claim 4 wherein the selection control signals of said home stereo system is media selection.

7. The spa audio system according to claim 4 wherein the selection control signals of said home stereo system is tone control.

8. The spa audio system according to claim 4 wherein the selection control signals of said home stereo system is sound equation control.

9. The spa audio system of claim 1 wherein the first end of the enclosure is glued to the spa shell.

10. The spa audio system of claim 1 wherein the enclosure is shaped to accommodate the transducer with the open second end being larger than the outer rim of the transducer, and the first closed end has a cylindrical puck therein for attachment to the transducer.

11. The spa audio system of claim 10 wherein the cylindrical puck is made of either plastic or metal.

12. In a spa having a flexible shell for holding water and a main control for controlling functions of the spa, an audio system for the spa comprising:

a) a first transceiver coupled to a home stereo system;

b) a second transceiver coupled to the main control;

c) an amplifier having an input coupled to the main control and having an output; and d) an audio transducer having an enclosure closed at a first end and open at a second end, the enclosure attached to an outer portion of the spa shell, and a transducer mounted in the enclosure for coupling sound vibration energy to the spa shell through the first end of the enclosure, the transducer being coupled to the output of the amplifier.

13. The spa audio system according to claim 12 further comprising:

a remote control capable of sending and receiving RF signals to and from said second transceiver.

14. The spa audio system according to claim 13 wherein said main control relays control selection signals received from said remote control to said first transceiver via said second transceiver for making selections of said home stereo system.

15. The spa audio system according to claim 14 wherein said selection control signals of said home stereo system is volume control.

16. The spa audio system according to claim 15 wherein said selection control signals of said home stereo system is media selection.

17. The spa audio system according to claim 16 wherein said selection control signals of said home stereo system is tone control.

18. The spa audio system according to claim 17 wherein said selection control signals of said home stereo system is sound equalization control.

* * * * *